United States Patent [19]

Paterson et al.

[11] 4,226,704

[45] Oct. 7, 1980

[54] COLLECTOR DISCHARGE APPARATUS

[75] Inventors: Malcolm M. Paterson, Lee; Michael R. Grubbs, Nashua, both of N.H.; Eugene J. Coulombe, Pepperell, Mass.; William J. Paxson, Cedar Rapids, Iowa

[73] Assignee: Raytheon Company, Lexington, Mass.

[21] Appl. No.: 882,501

[22] Filed: Mar. 1, 1978

[51] Int. Cl.[2] ..... B07B 4/02

[52] U.S. Cl. ..... 209/138; 209/492; 222/236

[58] Field of Search ..... 209/134–139 R, 209/147, 473, 254, 255, 257, 492, 493, 154; 198/557, 616, 502; 222/236

[56] References Cited

U.S. PATENT DOCUMENTS

| | | | |
|---|---|---|---|
| 2,653,712 | 9/1953 | Leighton et al. | 209/135 |
| 3,428,172 | 2/1969 | Hoffman | 209/147 |
| 3,442,379 | 5/1969 | Schneider et al. | 209/147 |
| 4,127,477 | 11/1978 | Schlobmann | 209/39 |

FOREIGN PATENT DOCUMENTS

| | | | |
|---|---|---|---|
| 2064609 | 7/1972 | Fed. Rep. of Germany | 198/557 |

*Primary Examiner*—Ralph J. Hill

*Attorney, Agent, or Firm*—John T. Meaney; Joseph D. Pannone; Richard M. Sharkansky

[57] ABSTRACT

A material handling apparatus comprising an air classifier system which includes a material receiving chamber having at its lower end a discharge conveyor which removes material from the chamber to another area, and conveyor means within the lower end portion of the chamber for moving material which has been deposited in the chamber and discharging it onto the discharge conveyor without clogging, together with suitable air locks and controls for regulating material flow through the apparatus.

15 Claims, 4 Drawing Figures

60
76
28
31
66
64
68
74
72
70
62
30
54
86
58
56
80
4

COLLECTOR DISCHARGE APPARATUS

BACKGROUND OF THE INVENTION

Plenums or other chambers are commonly used to receive and at least temporarily store fragmented or particulated material such as, for example, in various materials handling apparatus. One type of apparatus in which the present invention is particularly suitable is a rotary drum air classifier system wherein materials are deposited in a suitable plenum after being separated in and discharged from a rotary drum air classifier. Such a system is fully described in U.S. patent application Ser. No. 580,373, filed May 22, 1975 and now abandoned.

It will be understood that very often such systems are used to classify municipal waste which includes a mixture of materials of various densities containing various amounts of moisture. When the moisture content of a mixture is relatively high, it has been found that the various materials in the mixture will adhere together or coalesce. This is particularly true in the plenum where the materials may be deposited to a substantial height, the weight thus severely compacting the materials in the bottom portion of the plenum.

Adjacent the bottom of the plenum is usually located a discharge conveyor. A closure member normally closes a discharge opening in the lower end of the plenum. When the member is moved to open position, materials will fall through the opening onto the discharge conveyor. However, it has been found that sometimes the opening becomes clogged by the moisture-containing materials. This usually requires shutdown of the apparatus until the situation is corrected.

An attempt was made to seal the lower end of the plenum with discharge means in the form of one or more screw conveyors which would be activated to remove the packed materials from the plenum. Such a device, combined with moisture-removing means, was disclosed in U.S. patent application Ser. No. 647,267, filed Jan. 5, 1976 and now abandoned. However, screw conveyors were also found to be unsuitable for removing packed moisture-containing materials when used for this purpose.

SUMMARY OF THE INVENTION

The above and other objections to known prior art systems and apparatus are overcome in the present invention by the provision of a plenum or other collector or chamber which has one end of a discharge conveyor located within the lower end thereof, the conveyor extending out of the plenum through a wall thereof and sealed thereto by a suitable air lock to prevent undesirable interference with predetermined air flow through the plenum.

A second conveyor is completely enclosed within the lower portion of the plenum with its discharge end being positioned above the adjacent end of the discharge conveyor. Materials being deposited in the plenum will be guided by inclined walls onto the internal conveyor or directly onto the discharge conveyor. Thus, all materials will eventually be removed without interference by clogging.

In further accordance with this invention sonic sensors are provided to detect buildup of materials on the discharge conveyor. The sensors are electrically connected to the speed control mechanism of the discharge conveyor to cause it to increase in speed when the materials are built up to a predetermined level. Alternatively the sensors may be connected to the speed control mechanism of the feed conveyor which supplies material to the classifier and eventually to the plenum. Thus, when the buildup of materials on the discharge conveyor reaches the predetermined level, this will be detected by the sensors which will operate to cause the feed conveyor to operate at a reduced speed.

BRIEF DESCRIPTION OF THE DRAWINGS

The above and other objectives and advantages of the invention will become apparent from the following description taken in connection with the accompanying drawings, wherein.

DESCRIPTION OF THE PREFERRED EMBODIMENTS

Figure 1:
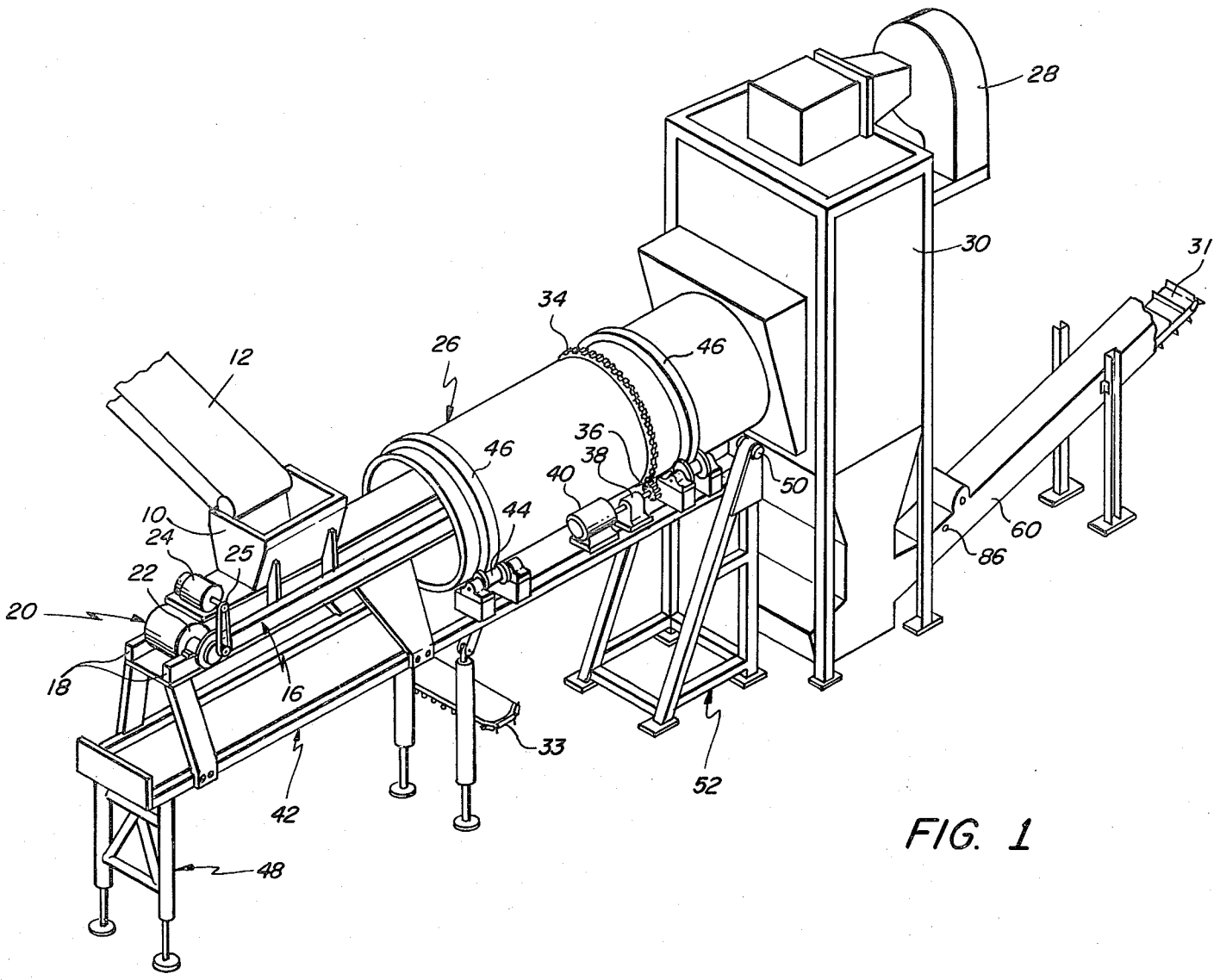
FIG. 1 is an isometric view of a materials handling system embodying the invention.

Referring more particularly to the drawings wherein like characters of reference designate like parts throughout the several views, the apparatus shown in FIG. 1 includes a number of cooperating devices arranged to automatically process and separate, commingled materials, these pieces of apparatus being parts of a complete waste resource separating and recovery system.

A feed hopper 10 receives unclassified waste or other mixture of materials from one end of an adjacent supply conveyor 12. The hopper 10 is mounted as by brackets 14 on a first frame 16 which comprises a pair of spaced parallel longitudinally-extending rails 18 secured together by suitable cross members. The hopper 10 is raised sufficiently above the frame 16 to permit a longitudinally extending feed conveyor 20 to be disposed beneath the hopper and preferably between the rails 18. The conveyor 20, as shown in FIG. 1, may be suitably supported on the rails 18 as by mounting its drum 22 on shafts which are journaled at opposite ends in the rails 18. A motor 24 with conventional belt and pulley drive mechanism 25 is utilized for moving the conveyor belt in a well-known manner.

The feed conveyor 20 projects into the interior of a horizontally disposed rotary air classifier drum 26 and is adapted to receive mixed materials to be classified from the bottom of the hopper and propel them into the drum. The materials have preferably been shredded to a size not exceeding about twelve inches, and the drum classifier separates the shredded materials in the known fashion of apparatus of this character. The drum 26 is angled at a selected inclination, such as 10°, for example, and air is caused to flow through it at high velocity by means of a fan or blower means 28 which may be suitably mounted on a plenum, cyclone or similar collecting chamber 30 into the higher end of which the drum 26 projects.

As raw mixed materials drop from the end of the feed conveyor 20 onto the bottom of the drum wall, the heavy materials in the mixture will be rotated upwardly with the drum to a point where, because of the inclination of the drum, they will fall to a lower point within the drum. Such tumbling action is repeated until eventually the heavy materials fall out of the lower end of the drum onto another conveyor 33 which will carry them away for further processing or disposal. The light materials deposited within the drum will be entrained within the high velocity air stream and will be carried out the upper end of the drum 26 into the collection chamber or plenum 30 from which they may be subsequently removed by a discharge conveyor 31 to a remote location for further processing, such as being converted into a refuse derived fuel, for example.

It is to be understood that the feed conveyor 20, which is illustrated herein as a belt-type device, may take other forms such as, for example, a screw feed as disclosed in U.S. Pat. No. 3,970,547 which is owned by the same assignee as the present invention. Also, the feed conveyor frame 16 and conveyor 20 thereon may be suitably supported for adjustment of the conveyor 20 with respect to the drum 26. Such adjustable support means may take any suitable form such as disclosed, for example, in U.S. patent application Ser. No. 832,719, filed Sept. 12, 1977 by Malcolm M. Paterson et al. and assigned to the assignee of the present invention. By proper positioning of the conveyor with respect to the rotating air drum, maximum efficiency of materials classification by the drum may be achieved.

Any suitable means may be used to rotate the drum 26. In FIG. 1 this means comprises a circumferential sprocket wheel 34 which is fixed around the drum at a point midway of its length and which meshes with a small sprocket wheel 36 rotatably mounted on one end of a reduction gear box 38 supported by a platform 42 beneath the drum and hopper. The gear box 38 is interconnected with a drive motor 40 whereby rotation of the drum is accomplished.

The drum 26 is supported upon the platform 42 by means such as a pair of rollers 44 which each engages a respective restraining ring or collar 46, the rings being fixed to and extending around the circumference of the drum near opposite ends thereof. The rollers 44 have flanges on their sides which engage opposite sides of the respective rings 46 to prevent longitudinal movement of the drum as it is rotated.

The platform 42 is pivotally supported at one end beneath the conveyor by vertically adjustable support means 48 and at its opposite end is pivotally mounted by a bearing 50 on the upper end of a fixed support 52. The platform 42 and consequently the drum 26, together with the conveyor apparatus, may be angled to a selected inclination, such as 10°, for example, by raising or lowering the platform 42 about the axis of the bearing 50.

It will be apparent that variations in the angle of inclination of the drum and variations in the velocity of the air flow through the drum will cause changes in the ratio of lights to heavies during a separation process. However, other factors also must necessarily be considered when attempting to achieve efficient desired classification of the mixed materials.

It will be apparent from FIG. 1 that during operation of the described apparatus the air stream created by blower means 28 will enter the lower end of the drum and will flow longitudinally through the drum and into the plenum or other collector 30. The air stream flowing through the plenum 30 will follow a path substantially as indicated by the arrows in FIG. 2, being deflected upwardly by the back wall of the plenum and by the forces created by the blower means 28.

Although the air stream carries out of the drum 26 only those materials which are considered "light" compared to the "heavy" materials which do not become air entrained, such "light" materials again become separated in the plenum 30 into light and heavy fractions. The light fractions continue to be entrained in the air stream which is deflected upwardly in the plenum and are removed from the upper portion of the plenum into subsequent processing or storage devices, not shown.

Meanwhile, the heavy fractions will fail to be supported by the air stream when the air stream is deflected upwardly, and gravitational forces will cause them to drop to the bottom portion of the plenum. It is at this point in the process that problems occur in many material storing devices such as, for example, clogging or plugging of the discharge openings in the lower ends of the plenum.

Figures 2, 3:
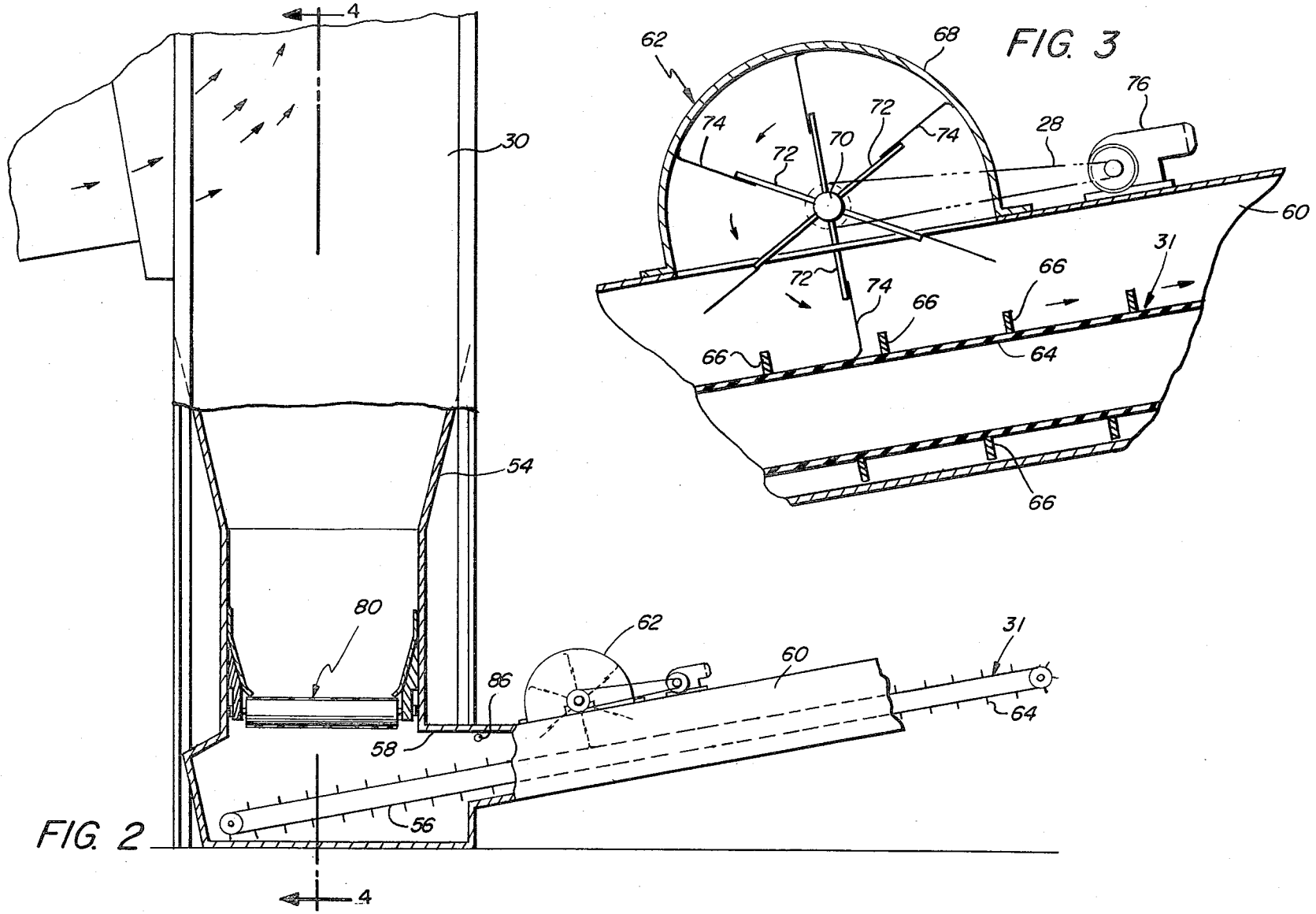
FIG. 2 is a side elevational view of the plenum shown in FIG. 1 and the conveyors associated with it, parts of which are shown in vertical section.
FIG. 3 is a vertical sectional view of the discharge conveyor air lock.

In accordance with the present invention, the discharge conveyor 31 has one end portion 56 which is disposed within the lower end of the plenum as shown best in FIG. 2. The end portion 56 preferably extends into the plenum through an opening 58 in the side wall 54 and the portion of the conveyor 31 which is immediately adjacent the outside of the plenum is enclosed within a conveyor conduit 60. The conduit 60 is mounted at one end to the plenum wall 54 over the discharge opening 58 and thus the interior of the conduit is in communication with the interior of the plenum. This lower end portion of the conveyor thus is completely enclosed and is air-sealed by a suitable air lock 62 which is mounted on the upper side of the conduit 60 as shown best in FIG. 3.

Figure 4:
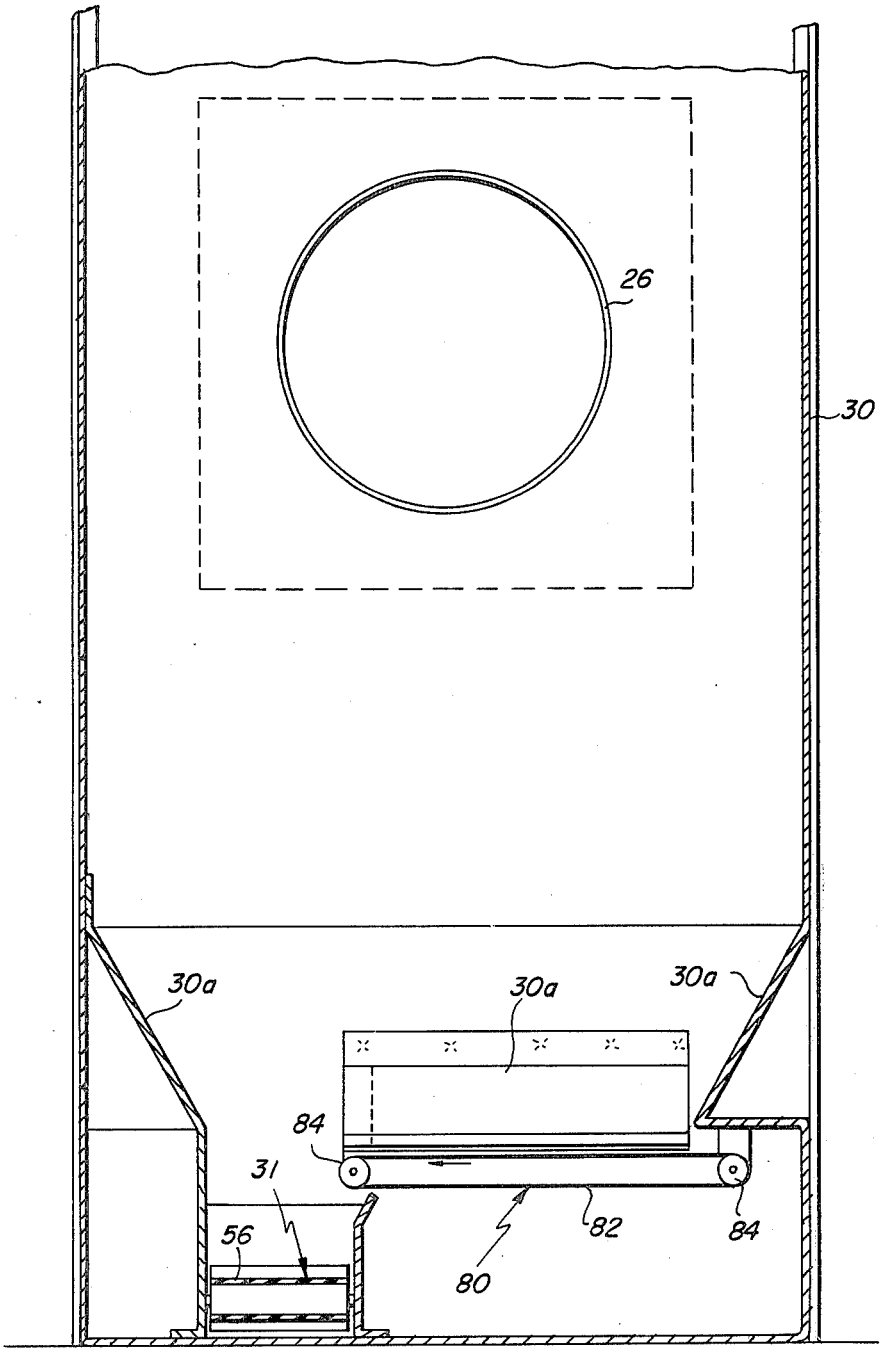
FIG. 4 is a vertical sectional view of the plenum and conveyors taken substantially on line 4—4 of FIG. 2 looking in the direction of the arrows.

The belt 64 of the conveyor 31 is adapted to move in the direction indicated by the arrow in FIG. 3, and is provided throughout its length with spaced transversely-extending fins 60. The fins, of course, move with the belt in the direction of the arrow and consequently simultaneously urge the light fractions on the belt outwardly away from the plenum as the belt moves. The air lock 62 comprises a raised semicylindrical housing 68 on conduit 60 which contains a transversely extending rotatable shaft 70 which has its end suitably journaled in the end walls of the housing 68. The shaft 70 carries a number of radially extending vanes 72 each of which carries a rubber fin 74. The length of each vane-fin combination is such that the edge of the fins 74 within the housing 68 engage the inner surface of the housing 68 when the shaft 70 is rotated, and at the lower circumference of the arrangement the fins 74 engage the upper surface of the belt. Also, the edges of belt 64 are disposed in close relationship with the side walls of conduit 60 as shown in FIG. 4, while the longitudinal edges of fins 66 on the belt are disposed relatively close to the bottom wall of the housing 60, as shown in FIG. 3. Thus, air is constantly prevented from being drawn through the conduit into the plenum.

The air lock 62 may be operated by a motor 76 and belt-pulley arrangement 78, if desired, or may be entirely operated by abutting action of the fins 66 upon the fins 74. With any such air lock, any substantial amount of air is prevented from passing into or out of the plenum through the discharge conveyor structure.

The foregoing description refers to the deposit of heavy fraction separated material within the plenum 30 for removal out the lower end of the plenum by conveyor 31. However, in accordance with this invention clogging or plugging of such material within the lower portion of the plenum is prevented by an internal conveyor 80 (FIGS. 2 and 4) which is located within the lower end portion of the plenum 30. Internal conveyor 80 extends perpendicular to the discharge conveyor 31. The plenum 30 has inwardly angled lower wall portions 30*a* which define a discharge opening beneath a major portion of which the internal conveyor 80 is disposed. Thus, a major portion of the material being deposited in the plenum 30 will fall directly onto the internal conveyor 80 or will be deflected onto it by the angled walls 30*a*.

The conveyor 80 comprises a belt 82 which moves in a conventional manner over two cylinders 84 and is supported within the plenum and operated by any suitable means so as to carry material deposited on it in the diredtion of the arrow in FIG. 4. The discharge end of internal conveyor 80 lies above the lower end portion 56 of the discharge conveyor 31. Thus, material being deposited into the plenum will fall onto either the internal conveyor 80 or the discharge conveyor 31 and will all be removed from the plenum. The internal conveyor 80, during operation of the system, prevents materials from plugging the discharge opening at the bottom of the plenum.

It will be apparent that by operating both conveyors 31 and 80 continually the materials in the plenum may be removed as fast as the discharge conveyor 31 can conveniently be operated. However, in further accordance with this invention, there is provided novel sensing means for detecting undesirable buildup of material on the lower portion 56 of the conveyor 31. Such sensing means comprises an ultrasonic sensing device 86 (FIGS. 1 and 2) which is disposed preferably in the side walls of the plenum 30 or the conduit 60 at or near a point where material on the belt 64 is moved into the conduit. When the material accumulates on the belt 64 to a predetermined level such accumulation breaks the sound path between the sensors 86. The sensors 86 are electrically connected to the driving means for the feed conveyor 12 and operate to slow the feed of material into the rotary drum, thus eventually relieving the problem at conveyor 31. The sensors 86 alternatively may be connected to the drive means for the discharge conveyor 31, causing it to speed up when accumulation of material on conveyor portion 56 has been sensed.

The sonic sensors 86 may be any suitable type such as those sold under the trade name SONAC by Delevan Electronics, Inc. of 14605 N. 73rd St., Scottsdale, Ariz. 85260.

From the foregoing description it will be apparent that a novel system has been achieved wherein materials may be easily and efficiently removed from a collector by means of a continually moving internal conveyor which constantly discharges onto a discharge conveyor.

It will also be apparent, however, that various modifications and changes in the structures shown and described and in their manner of operation may be made by those skilled in the art without departing from the spirit of the invention as expressed in the accompanying claims. Therefore, all matter set forth is to be interpreted as illustrative and not in a limited sense.

What is claimed is:

1. A material handling system comprising a collector having side walls defining a collecting space, a discharge opening located at a midpoint in a lower portion of the collector, means for creating a stream of air flowing upwardly through the collector whereby the lower end of the collector in the area of the discharge opening is under negative air pressure, means for depositing material into the collector at a level above said discharge opening whereby at least a portion of the material will fall out of the air stream toward the discharge opening, discharge conveyor means for removing material falling through the discharge opening, said discharge conveyor means having a material-receiving portion located within the collector at a level below the level of the discharge opening and having a major portion extending exteriorly of the collector through an exit opening in a wall of the collector, and air seal means attached to wall portions of the collector adjacent the exit opening for restricting passage of substantial amounts of air through the exit opening, the air seal means including conduit means disposed longitudinally about the major portion of the conveyor means and having wall portions spaced therefrom for providing an exit passageway, and rotatable means having a plurality of angularly spaced portions disposed in the conduit means for sequentially engaging the conveyor means and the spaced wall portions of the conduit means for permitting passage of material and blocking a flow of air therebetween.

2. A system as set forth in claim 1 wherein the air seal means includes means for rotating the angularly spaced portions of the rotatable means in accordance with operation of the conveyor means.

3. A system as set forth in claim 2 wherein said internal conveyor has a continuous belt, and the area of the belt which is exposed to material from the discharge opening is greater than one-half the area of the opening.

4. A system as set forth in claim 2 wherein the rotatable means includes an elongated rotor mounted for axial rotation transversely of the conveyor means and carrying a radially extending array of spaced fins which brushingly engage the conveyor means and overlying wall portions of the conduit means.

5. A system as set forth in claim 4 wherein said discharge conveyor extends in a direction perpendicular to the direction of the internal conveyor.

6. A material handling system comprising a collector having side walls defining an enclosed collecting space, a first discharge opening at a midpoint in a lower portion of the collector, feed means for depositing material into the collector at a level above said first discharge opening, a second discharge opening at a level above said feed means, means for creating flow of air at predetermined pressure through said feed means into the interior of the collector and out said second discharge opening whereby to entrain light fractions of commingled materials which are fed into the collector through said feed means and removing same through said second opening, discharge conveyor means for removing heavy fraction material falling through the first discharge opening, said discharge conveyor means having a material-receiving portion located within the collector at a level below the level of the first discharge opening and having a major portion extending exteriorly of the collector through an exit opening in one of the walls of the collector, and air-seal means attached to wall portions of the collector adjacent the exit opening for preventing flow of air through the exit opening, the air seal means including a conduit disposed longitudinally about the major portion of the conveyor means and having wall portions spaced therefrom, and rotor means having a radially extending array of angularly spaced fins disposed between the conveyor means and the spaced wall portions of the conduit means for sequential engagement therewith to block flow of air and permit passage of material therebetween.

7. A system as set forth in claim 6 wherein said air-seal means comprises a conduit enclosing a portion of the discharge conveyor exteriorly of the collector and having one end sealed to said one of the walls of the collector around the exit opening and air lock means mounted on said conduit and connected with said discharge conveyor for blocking flow of air through the conduit.

8. A system as set forth in claim 7 wherein the spaced wall portions include a semi-cylindrical wall portion of the conduit disposed transversely of the conveyor means.

9. A system as set forth in claim 8 wherein the rotor means comprises a shaft mounted for axial rotation in the semi-cylindrical wall portion of the conduit and carry a radially extended array of angularly spaced fins having respective flexible outer end portions.

10. A system as set forth in claim 8 wherein each of the fins extend radially from the shaft a greater distance than the distance from the shaft to the conveyor means.

11. A system as set forth in claim 10 wherein said discharge conveyor extends in a direction perpendicular to the direction of the internal conveyor.

12. A material handling system comprising:

materials classifying means disposed for separating one class of materials from commingled materials and including a collector having side walls defining a collecting space disposed for receiving therein the separated materials, one of the side walls having a lower portion provided with an exit opening;

discharge conveyor means disposed in a lower portion of the collector and extended exteriorly thereof through the exit opening for removing the separated materials from the collector; and air seal means coupled to the collector and to the conveyor means for permitting removal of the separated materials from the collector while blocking a substantial flow of air through the exit opening, the air seal means including;

conduit means having wall portions secured to the lower portion of the side wall about the exit opening and extended longitudinally in spaced relationship with the conveyor means for providing a passageway through which the conveyor means extends to remove separated materials from the collector, and rotatable means having a radially extended array of angularly spaced vanes disposed between the conveyor means and the spaced wall portions of the conduit means for sequential engagement therewith, to block a substantial flow of air between the conveyor means and the spaced wall portions of the conduit means while permitting passage of separated materials between the rotating vanes.

13. A material handling system as set forth in claim 12 wherein the vanes have respective outer flexible end portions disposed for brushingly engaging the conveyor means and the spaced wall portions of the conduit means.

14. A material handling system as set forth in claim 13 wherein the conveyor means comprises an endless belt extend longitudinally through the conduit means; and the vanes extend radially from a rotor disposed transversely of the belt.

15. A material handling system as set forth in claim 14 wherein the materials classifying means includes air blower means disposed to send a stream of air upwardly through the collector for entraining light fraction materials and allowing relatively heavier materials to fall downwardly into the collecting space.

* * * * *